United States Patent [19]

Mendenhall

[11] 4,136,966

[45] Jan. 30, 1979

[54] ASPHALT SLEEVE MIXER APPARATUS

[76] Inventor: Robert L. Mendenhall, 1770 Industrial Rd., Las Vegas, Nev. 89102

[21] Appl. No.: 758,316

[22] Filed: Jan. 10, 1977

Related U.S. Application Data

[63] Continuation of Ser. No. 616,910, Sep. 26, 1975, abandoned, which is a continuation-in-part of Ser. No. 488,518, Jul. 15, 1974, Pat. No. 4,000,000, and Ser. No. 601,177, Aug. 1, 1975, Pat. No. 4,034,968.

[51] Int. Cl.[2] ..... B28C 5/06

[52] U.S. Cl. ..... 366/25

[58] Field of Search ..... 366/22, 23, 24, 25, 366/27, 42, 53, 233, 234, 235

[56] References Cited

U.S. PATENT DOCUMENTS

| | | | |
|---|---|---|---|
| 2,421,345 | 5/1947 | McConnaughay | 366/25 |
| 2,448,042 | 8/1948 | Miller | 366/23 |
| 2,715,517 | 8/1955 | Bojner | 366/23 |
| 3,788,609 | 1/1974 | Toczyski | 366/303 |
| 3,845,941 | 11/1974 | Mendenhall | 366/25 |
| 3,866,888 | 2/1975 | Dydzyk | 366/25 |

*Primary Examiner*—Robert W. Jenkins
*Attorney, Agent, or Firm*—Seiler & Quirk

[57] ABSTRACT

In a mixing apparatus for asphalt-aggregate compositions including a rotatable cylindrical drum and utilizing an input end for introducing composition and an opposite output end for recovering or removing composition from the drum interior, the improvement comprises a final mixing chamber comprising a sleeve extending around the drum exterior adjacent the output end and rearwardly along a portion of the drum length with the drum exterior and sleeve defining the final mixing chamber, a plurality of fins or paddles secured to the rotatable drum exterior for mixing composition in the final mixing chamber and which fins assist in directing and removing composition along and from the mixing chamber.

12 Claims, 3 Drawing Figures

ASPHALT SLEEVE MIXER APPARATUS

BACKGROUND OF THE INVENTION

This application is a continuation of my application Ser. No. 616,910, filed Sept. 26, 1975, now abandoned, which is a continuation-in-part of applications Ser. Nos. 488,518, filed July 15, 1974, now U.S. Pat. No. 4,000,000 and 601,177, filed Aug. 1, 1975, now U.S. Pat. No. 4,034,968.

In my aforesaid copending applications as well as Ser. Nos. 487,928, filed July 12, 1974 and 601,176, filed Aug. 1, 1975, there are described processes and apparatus for recycling used asphalt-aggregate compositions. The apparatus, of which the present invention constitutes an improvement, includes an elongated cylindrical drum having a plurality of heating tubes extending substantially along the length of the drum interior. Used asphalt-aggregate compositions are introduced into an input end of the drum as it is rotated while heat is supplied to the tubes so that the composition becomes heated gradually and mixed as it contacts the heated tube surfaces. The drum is tilted so that the composition is drawn gravitationally from the input end to the output end. Descriptions in my aforesaid applications showing the apparatus and its use in introducing recycled asphalt-aggregate compositions are incorporated herein by reference.

After recovery of composition from the output end of the drum apparatus, it has been desirable to direct the mixture to a separate mixing apparatus such as a pugmill into which make-up asphalt and softening agent are introduced. Hot asphalt is distributed by a spray or gravity discharge along the pugmill interior while the agitating asphalt-aggregate composition is heated by a hot oil jacket or the like. The composition is directed to the separate mixer by way of a conveyor type apparatus in which there is usually significant heat loss from the material as it is transported between the cylindrical drum mixer and the pugmill. Moreover, the cost of such a separate secondary mixing apparatus is substantial as are operating expenses including repairs, heat requirements and the like.

SUMMARY OF THE INVENTION

It is an object of the present invention to incorporate a secondary or final mixing apparatus as an integral component of a cylindrical and rotatable mixing drum so that the requirement of a separate apparatus is obviated. It is another object to incorporate such a secondary mixing apparatus so that separate heating requirements are unnecessary. It is a further object to incorporate the mixing apparatus with the cylindrical heating drum in such a way that there is minimal heat loss between the composition directed from the drum to the secondary mixer. It is still another object to provide a secondary mixing apparatus which does not require separate mixer drives other than those used for rotating the cylindrical drum with which it is associated and used. It is yet another object to provide a secondary mixing apparatus used in combination with a rotatable cylindrical mixing drum which is relatively simple to load as well as recover the product therefrom. These as well as other objects and advantages will be evident from the detailed description.

DETAILED DESCRIPTION OF THE INVENTION

Figure 1:
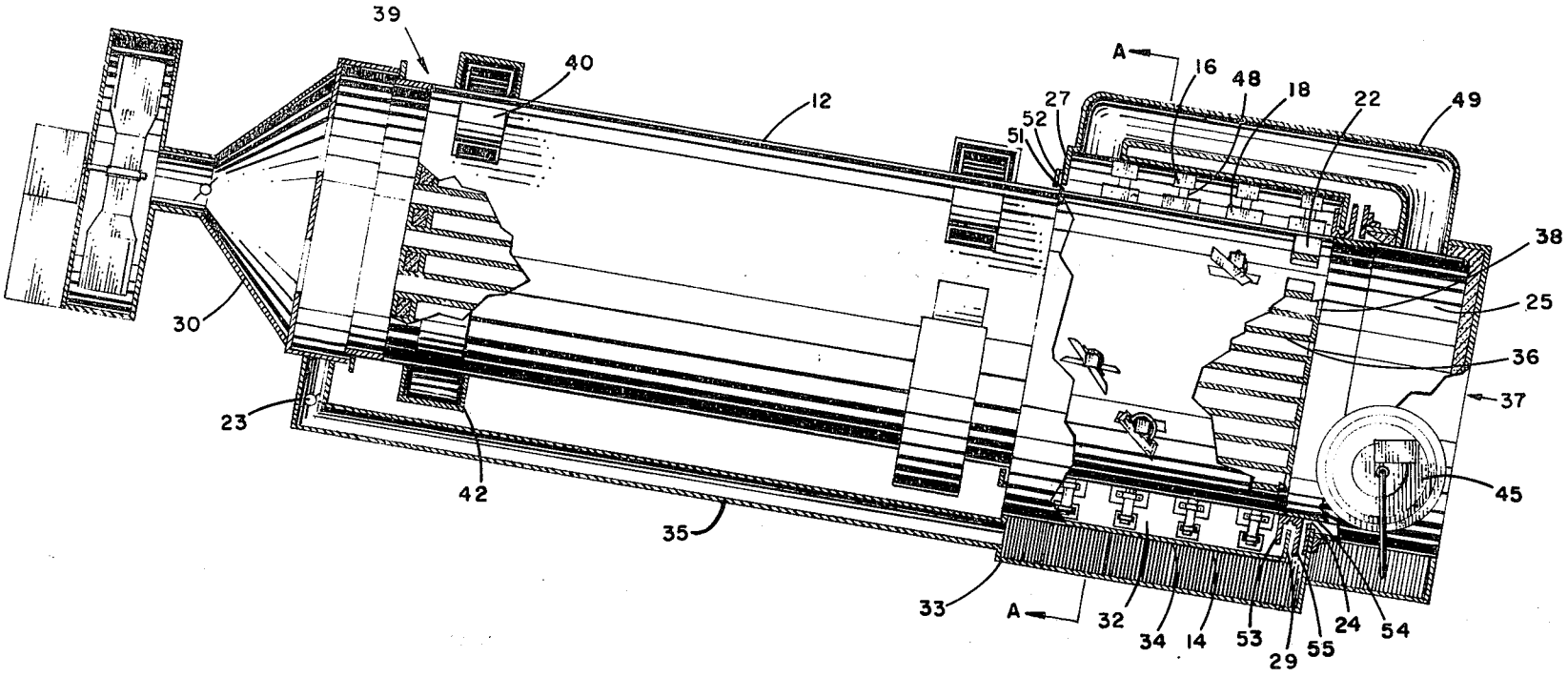
FIG. 1 is a side view of the apparatus, partially cut away and partially in section showing the interior of the sleeve mixer and components.
Figure 2:
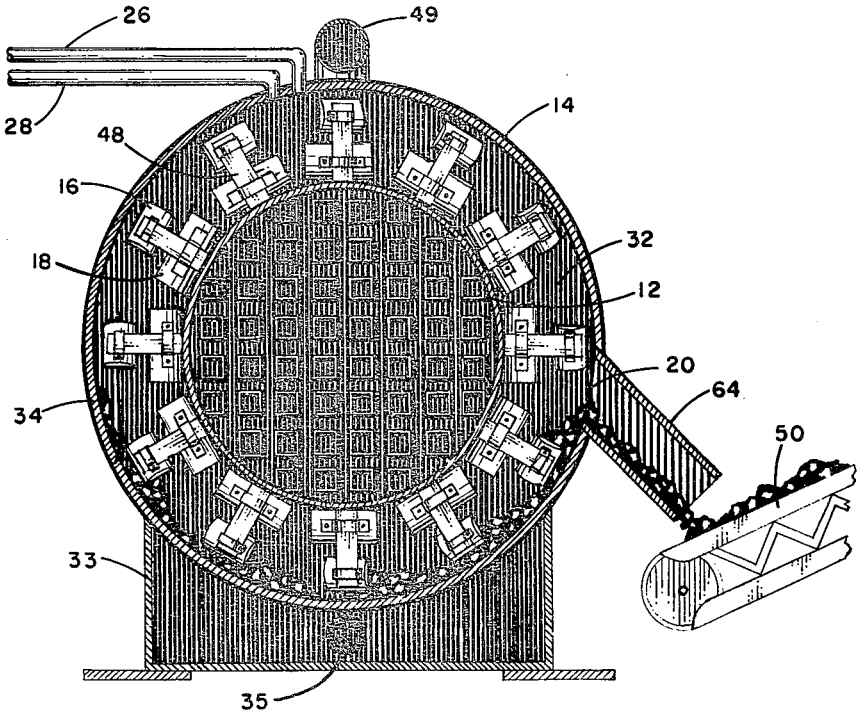
FIG. 2 is an end sectional view of the apparatus taken along lines A—A of FIG. 1.

Referring to FIGS. 1 and 2, there is shown a rotatable cylindrical drum 12 having an input end 39 at or adjacent which asphalt-aggregate composition is introduced and an output end 37 at or adjacent which composition is recovered from the drum. The drum has been extensively described in applicant's aforesaid co-pending application and generally incorporates a plurality of heating tubes or pipes 36 extending between the input and output drum ends as is illustrated in FIG. 1. Composition may be introduced via a chute assembly or through a plurality of ports 40 cooperating with scoops 41 and trough 42 as described in applicant's copending application Ser. No. 601,177, filed Aug. 1, 1975. The composition is then passed over and between the heated tubes as the drum is rotated and thus becomes gradually heated, mixed and more fluid as it flows gravitationally toward the output or front end of the cylindrical drum, the drum being tilted with the output end depressed somewhat from the input end.

A plurality of ports 22 extend around the perimeter of the drum exterior surface and communicate exteriorly thereof and with the drum interior so that the composition gravitationally falls or passes through the ports as it reaches the forward or output end. The size and spacing of the ports may be varied depending on the amount of composition desired to be removed from the drum during any given time interval and as described in my aforesaid co-pending application Ser. No. 601,177 and which description is incorporated herein by reference. As the asphalt-aggregate composition passes from the drum interior, through ports 22, it is received in the interior cavity 32 of sleeve 14. The sleeve comprises the stationary structure which extends around the forward portion of the rotating drum 12, and is preferably evenly or uniformly spaced from the drum exterior along the interior sleeve surface. In other words, wall 34 of sleeve 14 preferably has the same perimeter or circumferential shape as the exterior drum surface but the former is larger, i.e., has a greater diameter than the diameter of the cylindrical drum. Accordingly, wall 34, which extends along a portion of the drum length from forward end 39, is uniformly spaced whereby the shortest distance between the exterior drum surface and interior sleeve surface is substantially the same throughout.

In addition to side wall 34, sleeve 14 has a forward end wall 29 and a rear end wall 27 which extend toward the drum exterior surface but terminating slightly therefrom enough so that the sleeve will not interfere with the drum rotation since the sleeve is stationed in a fixed position during operation of the apparatus. This feature is shown in FIG. 1 wherein wall 27 terminates short of the exterior of drum 12 leaving a space or gap 51 extending circumferentially between the drum and the edge of the rear sleeve wall. A seal 52, preferably adjustably mounted on end wall 27 may be incorporated for further closing the space or gap. The space will be small enough to prevent significant, if any, composition passing therethrough. The forward sleeve wall 29 may fit between flange plates 53 and 55 secured to projection 54 of forward drum wall 38.

Secured to the exterior of drum 12 are a plurality of paddles or fins 16 for mixing composition in the chamber of sleeve 14. Since a function of the fins is not only to mix the composition but also to direct it gradually from the forward end of the sleeve chamber to the rearward end for recovery, it is important that the fins be angled and positioned so that the overall effect is to gradually urge the composition in the rearward direction. Moreover, preferably a plurality of lower fins 18 are used, also secured or attached to the exterior of drum 12. The fins are secured on posts 48 attached to drum 12. A number of fins 16 and 18 are angled so as to reverse or retard the rearward flow of composition during the mixing so that longer mixing times are achieved. Thus, some of the fins urge the composition rearwardly while others interrupt the rearward flow but with the overall flow being directed to the rear of the sleeve for recovery.

Figure 3:
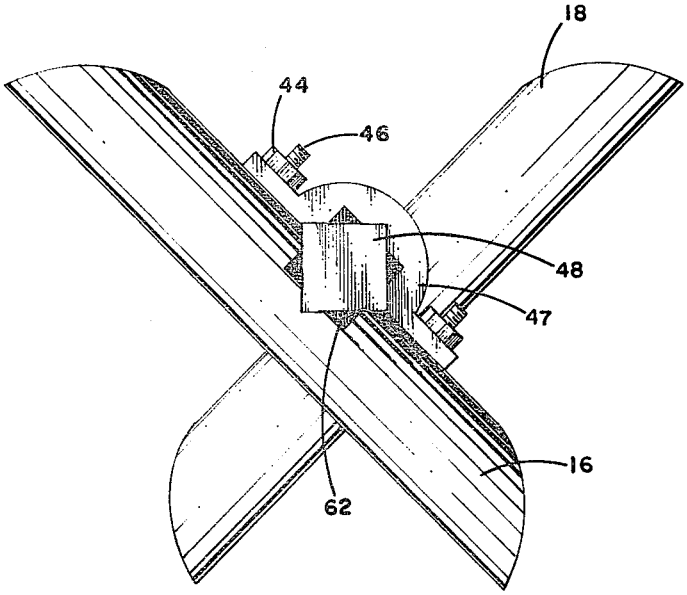
FIG. 3 is a detailed view showing means for varying the direction or pitch of the fins.

In order to achieve the desired mixing of the composition within the sleeve chamber and at the same time recover adequate or desired amounts of the composition continuously as the apparatus operates, it will be necessary to utilize suitable numbers of fins as well as to have them disposed or aligned along suitable angles. The posts are preferably aligned spirally around the drum which is believed to best achieve the desired mixing and yet advance the composition. In FIG. 1 only a few of the posts and fins are shown. Moreover, using square posts 48 for mounting the fins which have a notched surface for receiving the posts and incorporating notched brackets 47 as shown in FIG. 3, allows the fins to be oriented to achieve the desired mixing times and composition advance. As shown in FIG. 3, posts 48 are square in cross section while the fins have a star shaped slotted surface 62 along one side midway or centered along one side of the fin. A mounting bracket 47 also has similar slots for receiving corners of the square post with the bracket secured to a fin by threaded screws 46 and nuts 44. The screws may threadedly engage the fins or be permanently welded or formed to the fins. By using such an arrangement, both upper and lower fins 16 and 18 may be mounted on a post in parallel, at 45° or 90° relative to one another. Moreover, the angle of the fins can thus be varied by simply loosening the bracket and moving selected fins to the desired angle. Again, the specific angles at which the fins are set may be varied so long as the desired mixing times within the sleeve chamber are achieved. In addition, the specific length of the fins may be any suitable length to achieve the desired result as may be their number.

FIG. 2 illustrates a composition recovery port 20 located at or adjacent the rear wall of sleeve 14. Since the sleeve is stationary with drum 12 rotating and thereby also turning fins 16 and 18 secured on posts 40 around the exterior of the drum, as the composition is gradually mixed by the agitation of the fins, it is simultaneously gradually directed to port 20. It will be noted that the port is located to one side in the lower portion of the sleeve exterior side wall 34 adjacent the rear wall 27 seen in FIG. 1. At least one of the fins will be positioned to push composition directly into port 20 where it falls through chute 64 and onto conveyor 50. In this manner, composition directed rearwardly by the elongated fins passes into the port and gravitationally falls therethrough where it is recovered for use.

In addition to thorough mixing and substantial homogenization of the composition within sleeve chamber 32, there is preferably introduced make-up asphalt and a softening agent via conduits 26 and 28 which conduits have openings or ports communicating with the interior of the sleeve. It has been found, according to the invention, that make-up asphalt need only be introduced in the sleeve mixing chamber to used asphalt-aggregate composition which has been previously thoroughly mixed, heated and somewhat fluidized in the rotating cylindrical drum. Thus, a determination may be made on the amount of make-up asphalt required to be added to the asphalt-aggregate composition introduced into the drum in order to achieve a final product having the desired penetration characteristics, and that amount then metered into the hot mixture within the sleeve mixing chamber. Thereafter, with the fins rotating within that chamber to agitate the composition including the make-up asphalt added therein, a homogeneous mixture having the desired characteristics is achieved.

In addition to make-up asphalt added to a used asphalt-aggregate composition treated according to the invention, it may be desirable or necessary to add to the mixture a softening agent or product that will replace aromatic hydrocarbons or other volatiles deficient in the used material. For example, it has been found that used asphalt-aggregate compositions which are to be recycled according to the invention have lost a portion of the original hydrocarbons present in the asphalt at the time that the original composition was produced. Particularly common is loss of volatile or lighter aromatic hydrocarbons so that replacing or replenishing these materials is desired in order to achieve the final composition having the desired flow and penetration characteristics when laid to form a new road surface. Although as disclosed in my previous application Ser. No. 488,518, filed July 15, 1974 this may be accomplished within the cylindrical drum, it has been found advantageous to add the composition in the sleeve mixing chamber, for example, via one of the conduits 28 or 26 with the required amounts being metered and mixed by the rotating fins. Accordingly, utilizing the sleeve mixing apparatus of the present invention, the hot used asphalt-aggregate composition recovered from the cylindrical drum may be compounded with both make-up asphalt and softening agent, such as aromatic hydrocarbons, especially those having at least 50% aromatics, in the sleeve mixing chamber and thereafter recovered as a final composition for use as an asphalt surfacing material.

In another embodiment, a jacket 33 is provided around a portion of sleeve 14 in which jacket hot gases from combustion chamber 25 are directed. Most of the gases of combustion from burner 45 are directed into heating pipes 36 for heating composition mixing in drum 12. However, in order to provide some heat for maintaining suitable high composition temperatures in the sleeve mixer, port 24 communicates between the combustion chamber and jacket 33 whereby some of the hot gas heats the sleeve. The gases are then drawn through conduit 35 into exhaust assembly 30 to be vented. A damper 23 along the conduit will assist in regulating the gas flow. Accordingly, the apparatus achieves an additional advantage of obviating separate heaters, or hot oil sleeves other than the combustion chamber being utilized on and for the cylindrical drum.

Because of these characteristics, the apparatus achieves significant advantages over previously used pugmills.

In FIGS. 1 and 2 there is illustrated yet another embodiment in which volatile hydrocarbon gases given off by the hot composition in the sleeve are directed into combustion chamber 25 via pipe 49. This will prevent the unburned hydrocarbons and smoke from being vented directly into the atmosphere. Instead, the gases are directed to the combustion chamber for further oxidation by burner 45. Other modifications of the apparatus within the purview of the invention will be evident to those skilled in the art.

I claim:

1. In a mixing apparatus for asphalt-aggregate compositions including a rotatable cylindrical drum, means for introducing composition at an input drum end and means for recovering composition at an opposite output drum end, the improvement comprising:

a sleeve extending around the drum exterior from the output end along a portion of the drum length, the sleeve and drum exterior defining a mixing chamber therebetween, port means communicating between the mixing chamber and the drum interior for directing composition from the drum interior to the mixing chamber, means in the mixing chamber for advancing the composition therein from the port means to a recovery means, and means for recovering composition from the mixing chamber.

2. The apparatus of claim 1 including means for maintaining the sleeve in stationary position and means for rotating the drum.

3. The apparatus of claim 2 wherein the means for advancing the composition comprises a plurality of fins secured to the drum exterior and received in the mixing chamber.

4. The apparatus of claim 3 wherein the drum is tilted whereby the input end is elevated with respect to the output end with the sleeve having a circumferential interior surface uniformly spaced around the exterior drum surface.

5. The apparatus of claim 4 wherein a portion of the fins are disposed at different angles from other of said fins.

6. The apparatus of claim 5 including means for adjusting the fin angles.

7. The apparatus of claim 5 including a plurality of posts secured to drum exterior on which the fins are attached.

8. The apparatus of claim 5 wherein the sleeve includes a sleeve port for recovering composition.

9. The apparatus of claim 8 wherein the drum ports are located adjacent the forward drum end and the sleeve port is located adjacent the rear sleeve end.

10. The apparatus of claim 5 including a combustion chamber, a burner for supplying heat thereto, a jacket extending around a portion of the sleeve and a port communicating the combustion chamber and sleeve interior.

11. The apparatus of claim 5 including a combustion chamber, a burner for supplying heat thereto, and a conduit extending between the jacket and combustion chamber for directing volatile hydrocarbons from the sleeve interior to the combustion chamber.

12. In a mixing apparatus for asphalt-aggregate compositions comprising a rotatable cylindrical drum in which the composition is advanced gravitationally from an input end to an opposite output end, the improvement comprising:

a sleeve extending around the drum exterior from the output end along a portion of the drum length and having a mixing chamber therein, said sleeve having a forward end adjacent said drum output end and an opposite rearward end, a plurality of ports in said drum output end for directing composition from the drum interior to the sleeve mixing chamber adjacent said forward sleeve end, means in said sleeve mixing chamber for advancing the composition from said forward sleeve end to said rearward end, and means for recovering composition from said sleeve mixing chamber.

* * * * *